US007631820B2

(12) United States Patent
Bowman et al.

(10) Patent No.: US 7,631,820 B2
(45) **Date of Patent: *Dec. 15, 2009**

(54) SPRAY NOZZLE AND SWIRL DISK THEREFOR

(75) Inventors: Thomas P. Bowman, Greenfield, MA (US); Michael J. Mikaelian, Florence, MA (US); Daniel T. deLesdernier, Greenfield, MA (US); Ronald H. Emerson, Huntington, MA (US); Lincoln Soule, Wendell, MA (US); Matthew Bete, Greenfield, MA (US); Douglas J. Dziadzio, Montague, MA (US)

(73) Assignee: Bete Fog Nozzle, Inc., Greenfield, MA (US)

( * ) Notice: Subject to any disclaimer, the term of this patent is extended or adjusted under 35 U.S.C. 154(b) by 540 days.

This patent is subject to a terminal disclaimer.

(21) Appl. No.: 10/527,141

(22) PCT Filed: Sep. 9, 2003

(86) PCT No.: PCT/US03/28172

§ 371 (c)(1),
(2), (4) Date: Mar. 9, 2005

(87) PCT Pub. No.: WO2004/022241

PCT Pub. Date: Mar. 18, 2004

(65) Prior Publication Data

US 2006/0049282 A1 Mar. 9, 2006

Related U.S. Application Data

(63) Continuation of application No. 10/272,241, filed on Oct. 16, 2002, now Pat. No. 7,198,201.

(60) Provisional application No. 60/409,527, filed on Sep. 9, 2002.

(51) Int. Cl.
*B05B 1/34* (2006.01)

(52) U.S. Cl. ..... 239/494; 239/468; 239/497; 239/596; 239/600; 216/100

(58) Field of Classification Search ..... 239/1, 239/11, 468, 472, 600, 491–497, 596; 216/83, 216/100

See application file for complete search history.

(56) References Cited

U.S. PATENT DOCUMENTS 2,719,755 A 10/1955 Stanley (Continued)

FOREIGN PATENT DOCUMENTS

DE 199 18 120 A1 10/2000
JP 11 290725 A 10/1999

OTHER PUBLICATIONS

Thach H. Bui, Examiner, Office Action issued Aug. 12, 2004 in U.S. Appl. No. 10/272,241.
Supplementary European Search Report for European Patent Application No. EP 03 75 2123—Mar. 24, 2009.

*Primary Examiner*—Steven J Ganey
(74) *Attorney, Agent, or Firm*—McCarter & English, LLP

(57) ABSTRACT

A spray nozzle includes a body defining an inlet chamber and an outlet. An orifice disk, adjacent the outlet, has opposing surfaces, an inner sidewall extending between the opposing surfaces which defines an orifice, and a peripheral sidewall extending between the opposing surfaces for centering the orifice disk within the inlet chamber. A swirl disk, adjacent to the orifice disk, has opposing surfaces and a sidewall extending between the opposing surfaces. The sidewall of the swirl disk forms a periphery for centering the swirl disk, a hollow for creating a vortex adjacent to the orifice and an inlet for channeling fluid from the periphery to the hollow. A plug is fixed within the inlet chamber of the body for retaining the orifice and swirl disks as well as defining an annulus area in fluid communication with the inlet of the swirl disk.

24 Claims, 18 Drawing Sheets

U.S. PATENT DOCUMENTS 2,746,801 A * 5/1956 Curran ..... 239/494
2,904,263 A 9/1959 Tate et al.
3,182,916 A 5/1965 Schulz
3,532,271 A 10/1970 Polnauer
3,680,793 A 8/1972 Tate et al.
3,771,728 A 11/1973 Polnauer
3,887,137 A 6/1975 Nakamura et al.
4,531,677 A 7/1985 Suzuki et al.
4,613,079 A 9/1986 Maines
4,967,964 A 11/1990 Pamper
5,435,885 A 7/1995 Jones et al.
5,437,413 A 8/1995 Shen et al.
5,570,841 A * 11/1996 Pace et al. ..... 239/497
5,740,967 A 4/1998 Simmons et al.
5,934,569 A * 8/1999 Soule et al. ..... 239/468
5,951,882 A 9/1999 Simmons et al.
5,996,912 A * 12/1999 Ren et al. ..... 239/585.5
6,186,417 B1 2/2001 Ho et al.
6,193,172 B1 2/2001 Soule et al.
7,198,201 B2 * 4/2007 Bowman et al. ..... 239/497

* cited by examiner

FIG. 5C
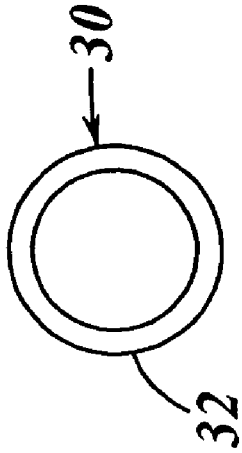
FIG. 5A
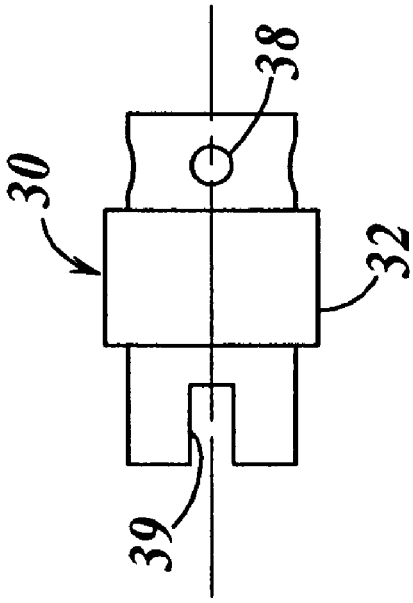
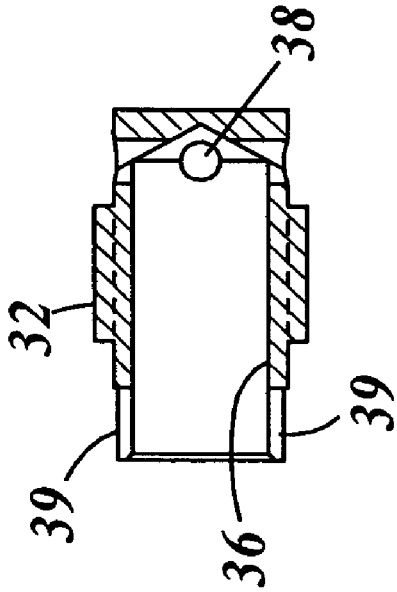
FIG. 5B
FIG. 5D
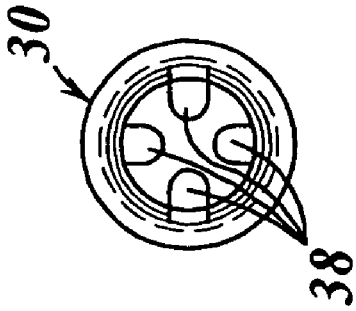

SPRAY NOZZLE AND SWIRL DISK THEREFOR

CROSS-REFERENCE TO RELATED APPLICATION

The present application is the U.S. National Stage Entry of International Application No. PCT/US2003/028172, filed Sep. 9, 2003, and is continuation of U.S. patent application Ser. No. 10/272,241, filed Oct. 16, 2002, now U.S. Pat. No. 7,198,201, which claims the benefit of U.S. Provisional Application Ser. No. 60/409,527, filed on Sep. 9, 2002, all of which are hereby expressly incorporated by reference as part of the present disclosure.

BACKGROUND OF THE INVENTION

1. Field of the Invention

The subject disclosure relates to fine spray nozzles, and more particularly to nozzles which create a vortex to form a fine spray.

2. Background of the Related Art

Traditionally, fine spray nozzles utilize either an impingement or an air-atomizing design to produce small droplets. Impingement is simply directing the flow of fluid through an orifice onto a pin to generate the spray. A primary disadvantage of impingement designs is that the target pin is difficult to align and can easily become damaged or misaligned resulting in poor performance. Moreover, a target pin may become dislodged and create damage downstream. Another drawback associated with impingement nozzles is that the orifice/pin feature tends to wear over the life of the nozzle which, in turn, may adversely affect spray pattern and drop size over the life of the nozzle. Air-atomizing designs are another well-known type of design which utilizes a source of pressurized air to atomize the fluid. A primary disadvantage of the air-atomizing designs is the increased expense of providing and maintaining the source of pressurized air.

In view of the above, several nozzles which utilize a swirling flow have been developed as alternatives. Swirling flow nozzles convert the head pressure of the fluid into kinetic energy within a swirl chamber. The swirling action causes the liquid to form into a thin, conical sheet that disintegrates into droplets under the action of aerodynamic and surface tension forces. Exemplary swirl flow nozzles are shown in U.S. Pat. Nos. 3,771,728; 3,532,271; and 6,186,417. Heretofore, several factors have limited the applicability of swirl flow nozzles, including: poor tolerance when machining the materials from which the nozzles are made; the spray patternation quality deteriorates as the size of the swirl chamber decreases; clogging due to smaller dimensions; and small parts become difficult to handle and assemble.

There is a need, therefore, for an improved small spray nozzle that overcomes one or more of the above-described drawbacks of the related art.

SUMMARY OF THE INVENTION

The present invention is directed to a spray nozzle comprising a body defining an inlet aperture and an outlet aperture. An orifice disk of the spray nozzle is receivable within the body adjacent to the outlet opening and includes a sheet material substrate defining a first surface formed on one side of the substrate, a second surface formed on an opposite side of the substrate relative to the first surface, a side surface extending between the first and second surfaces and defining a peripheral edge of the orifice disk, and a spray orifice extending through a first region of the substrate spaced inwardly relative to the peripheral edge. A swirl disk of the nozzle is receivable within the body adjacent to the orifice disk and includes a sheet material substrate defining a first surface formed on one side of the substrate, a second surface formed on an opposite side of the substrate relative to the first surface, and a side surface extending between the first and second surfaces and defining a peripheral edge of the swirl disk. A swirl chamber of the swirl disk is defined by a first aperture extending through a first region of the substrate spaced inwardly relative to the peripheral edge, and a swirl inlet is defined by a second aperture formed through a second region of the substrate extending between the swirl chamber and peripheral edge. A plug of the nozzle is receivable within the body adjacent to the swirl disk for retaining the swirl disk and orifice disk within the body. The plug defines a fluid flow path coupled in fluid communication between the inlet of the body and the inlet of the swirl disk for directing fluid flowing through the inlet of the body into the swirl chamber and, in turn, imparting a swirling flow to the fluid prior to discharging the fluid through the spray orifice in a spray pattern emanating therefrom.

The present invention also is directed to a method of forming a swirl disk of a spray nozzle, wherein the method includes the steps of: (1) providing a sheet of material for forming the swirl disk therefrom; and (2) forming at least one swirl disk from the sheet of material by (i) removing material about a peripheral portion of the swirl disk and, in turn, forming a peripheral edge of the swirl disk, (ii) removing material from at least one first region of the swirl disk spaced inwardly relative to the peripheral edge of the swirl disk and, in turn, forming a first aperture extending through the first region and defining a swirl chamber, and (iii) removing material from at least one second region of the swirl disk extending between the swirl chamber and peripheral edge of the swirl disk and, in turn, forming a second aperture extending through the second region and defining a flow inlet to the swirl chamber.

In a currently preferred embodiment of the present invention, the method further comprises the step of providing an orifice disk for use with the swirl disk of the spray nozzle. The step of providing the orifice disk includes the steps of: (1) providing a sheet of material for forming the orifice disk therefrom; and (2) forming at least one orifice disk from the sheet of material by (i) removing material about a peripheral portion of the orifice disk and, in turn, forming a peripheral edge of the orifice disk, and (ii) removing material from at least one first region of the orifice disk spaced inwardly relative to the peripheral edge of the orifice disk and, in turn, forming a first aperture extending through the first region and defining a spray orifice.

In one embodiment of the present invention, each step of removing sheet material is performed by etching. In addition, the first and second surfaces of the swirl disk are preferably symmetrical about a plane perpendicular to the axis of the spray nozzle. Also in a currently preferred embodiment of the present invention, the first and second surfaces of the swirl disk are substantially planar throughout. In yet another currently preferred embodiment of the present invention, the first and second surfaces of the swirl disk are substantially identical.

One advantage of the present invention is that the nozzles utilize a vortex to create a fine mist, thereby enabling a reduction in manufacturing complexity and maintenance costs while permitting increased reliability and performance in comparison to prior art impingement and/or air-atomizing nozzles.

Another advantage of a currently preferred embodiment of the present invention is that it permits the exchange of variously configured swirl and orifice disks to fine tune nozzle performance for a specific application.

It should be appreciated that the present invention can be implemented and utilized in numerous ways, including without limitation as a process, an apparatus, a system, a device (including, for example, a nozzle assembly, a swirl disk and an orifice disk) and a method for applications now known and later developed. These and other unique features of the invention disclosed herein will become more readily apparent from the following detailed description of preferred embodiments, claims and the accompanying drawings

BRIEF DESCRIPTION OF THE DRAWINGS

So that those having ordinary skill in the art to which the disclosed invention appertains will more readily understand how to make and use the same, reference may be had to the drawings wherein:

FIG. 5A is a side view of a plug for the nozzle of FIG. 1;

FIG. 5B is a cross-sectional view of the plug for the nozzle of FIG. 1;

FIG. 5C is an end view of the plug for the nozzle of FIG. 1;

FIG. 5D is another end view of the plug for the nozzle of FIG. 1;

DETAILED DESCRIPTION OF PREFERRED EMBODIMENTS

Figure 1:
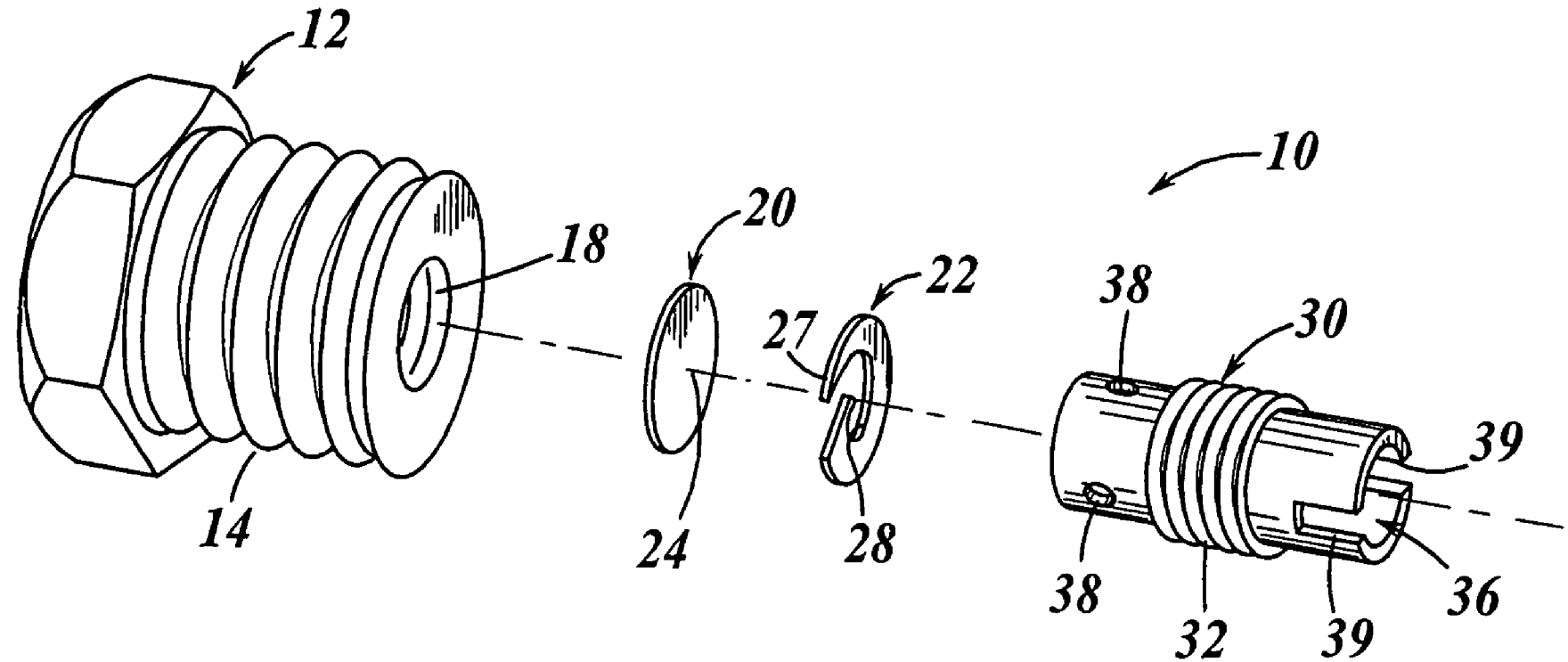
FIG. 1 is a perspective exploded view of a first nozzle embodying the present invention.

The present invention overcomes many of the prior art problems associated with spray nozzles. The advantages, and other features of the nozzles disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

Figure 2C:
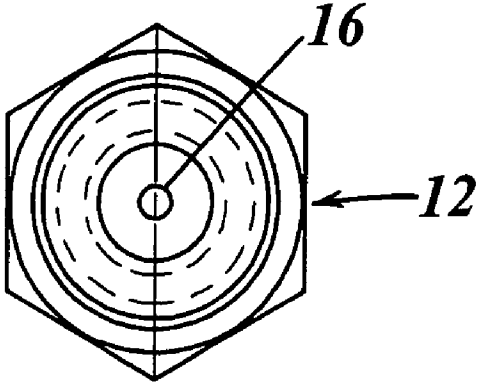
FIG. 2C is an end view of the body for the nozzle of FIG. 1.
Figure 2B:
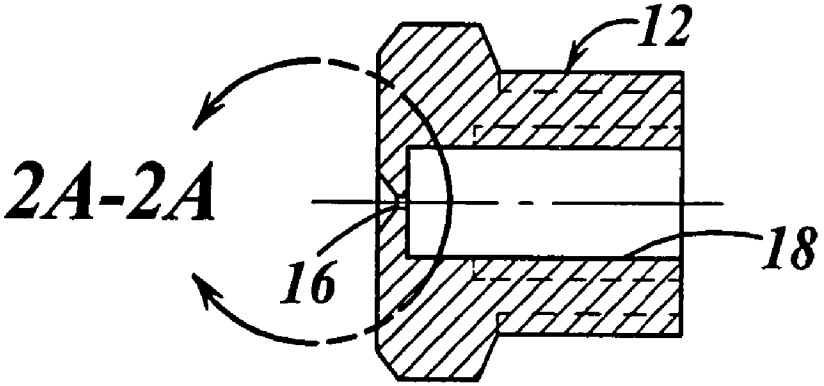
FIG. 2B is a cross-sectional view of the body for the nozzle of FIG. 1.
Figure 2A:
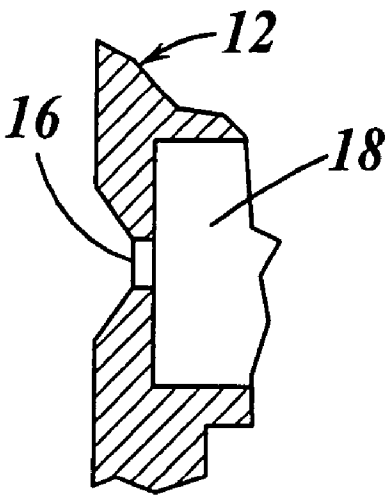
FIG. 2A is an enlarged partial, cross-sectional view of a body for the nozzle of FIG. 1.

Referring to FIG. 1, an exploded view of a nozzle referred to generally by reference numeral 10 is shown. The nozzle 10 has a body 12 for engaging a pipe or other structure (not shown) by a threaded end 14. The body 12 defines an outlet 16 (see FIGS. 2A-C) for discharging the liquid. An inlet chamber 18 is formed in the body 12 for receiving an orifice disk 20 and a swirl disk 22. A plug 30 retains the disks 20, 22 in place. As described further below, the orifice and swirl disks 20, 22 are each formed of a sheet material, such as stainless steel or other metal, by an etching or other feasible technique or process. The term sheet material or sheet-like material is used herein to mean a piece of any material that is broad in extent and comparatively thin. In addition, the term disk is used herein to mean a thin, substantially flat article that may define planar surfaces, but also may define depressed or elevated portions on or within its surfaces.

The nozzle 10 is scalable to a number of different flow rates, droplet sizes and spray angles. For example, the nozzle 10 may be configured to function under very low flow rates (less than about 0.05 gpm) and still produce a population of droplets with a Sauter Mean Diameter on the order of about 20 microns at pressures of about 1000 psi. As a result, for systems in which the nozzle of the present invention is installed, the required flow of liquid can be achieved with reduced initial costs for pumping equipment and/or lower operating costs in comparison to such systems employing prior art spray nozzles. Exemplary pipe sizes are ⅛" and ¼"

pipes. Exemplary applications for the nozzle 10 include, without limitation, turbine cooling, fire misting, livestock cooling, gas quenching, humidification, evaporative cooling, coating, spray drying of low abrasion liquids, area misting, cooling of castings, direct contact cooling, and the like.

Figure 3A:
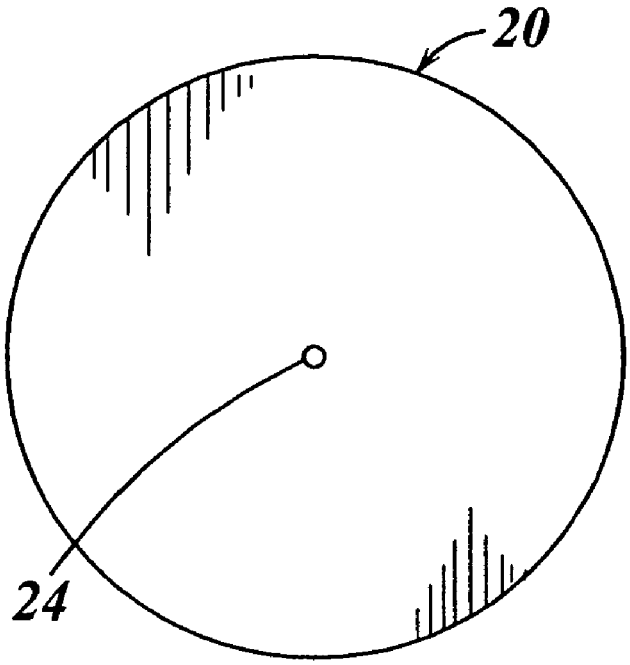
FIG. 3A is a front view of an orifice disk for the nozzle of FIG. 1.
Figure 3B:
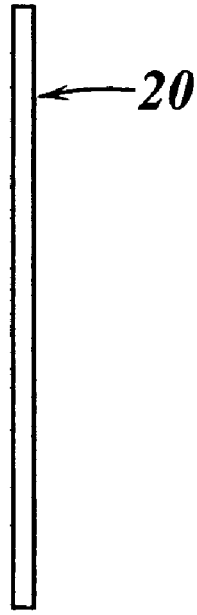
FIG. 3B is a side view of the orifice disk for the nozzle of FIG. 1.
Figure 4A:
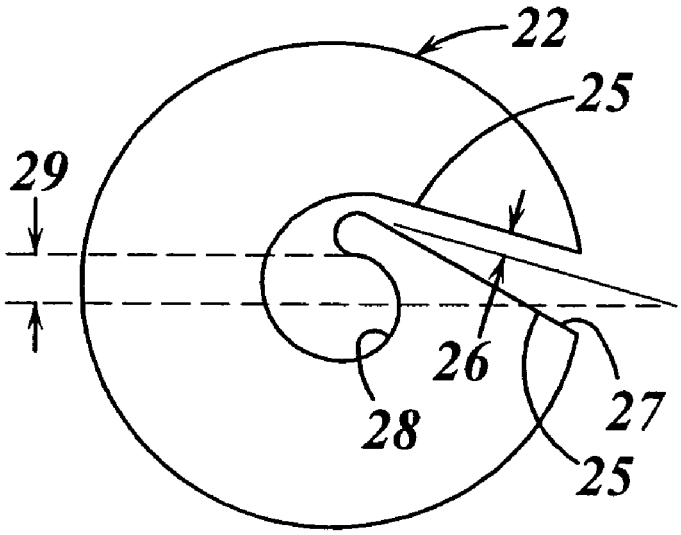
FIG. 4A is a front view of a swirl disk for the nozzle of FIG. 1.
Figure 4B:
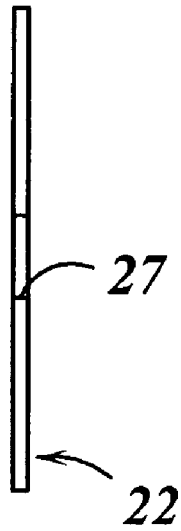
FIG. 4B is a side view of the swirl disk for the nozzle of FIG. 1.

Referring to FIGS. 3A and 3B, the orifice disk 20 has a central aperture 24 and is placed in the bottom of the inlet chamber 18 so that the central aperture 24 is adjacent to and axially aligned with the outlet 16 of the body 12. Referring to FIGS. 4A and 4B, the swirl disk 22 has a substantially central hollow 28 defining a swirl chamber for forming a vortex of the liquid therein. The swirl disk 22 is placed adjacent to the orifice disk 20 in the chamber 18 so that the central hollow 28 is adjacent to and axially aligned with the central aperture 24. The disks 20, 22 are round which creates a self-centering effect within the chamber 18 of the body 12. The disks 20, 22 are also symmetrical (e.g., each disk is symmetrical about a respective plane approximately perpendicular to the axis of the nozzle) so that the nozzle 10 can be easily assembled and reversal will not impact performance. Therefore, the nozzles of the present invention not only avoid the need for a pin or a source of pressurized air as required by prior art impingement and air-atomizing nozzles, but the nozzles of the present invention further avoid the difficulties of assembling and/or aligning individual parts that are associated with certain prior art spray nozzles. Although the currently preferred embodiments of the swirl and orifice disks define circular peripheries, the peripheries of these parts may take any of numerous different shapes that may be desired or otherwise required for different applications. For example, the swirl and/or orifice disks may each define a rectangular, oval, or other irregular-shaped periphery.

The swirl disk 22 also forms an inlet 27 in fluid communication with the central hollow 28 for channeling fluid thereto. The inlet 27 expands gradually from a throat 26 at the central aperture towards the periphery of the swirl disk 22. The throat 26 is determined at the point where the straight portions 25 of the inlet 27 become arcuate. The swirl disk start radius 29 is the minimum radius of the central hollow or swirl chamber 28 of the swirl disk 22. Among other parameters, varying the throat ratio, which is the ratio of the throat 26 to the swirl start radius 29, will vary the shape of the vortex formed within the central hollow 28. Preferably, the throat ratio is within the range of about 3:5 to about 11:10.

Figure 6A:
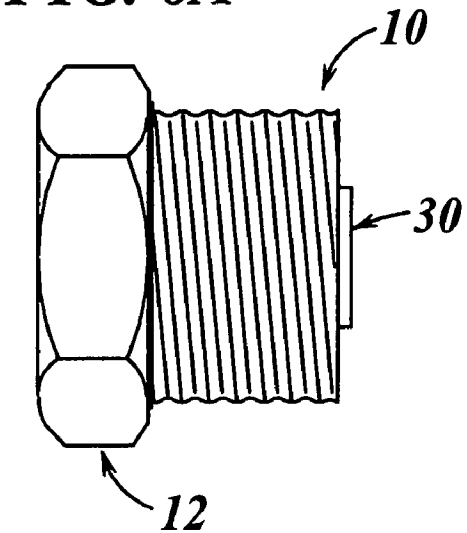
FIG. 6A is a side view of the nozzle of FIG. 1 in an assembled state.
Figure 6B:
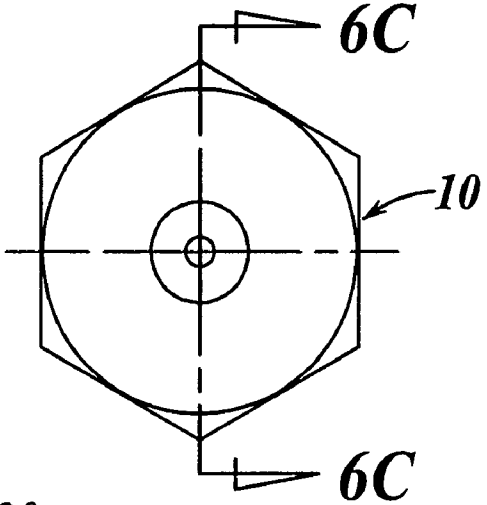
FIG. 6B is an end view of the nozzle of FIG. 6A.
Figure 6C:
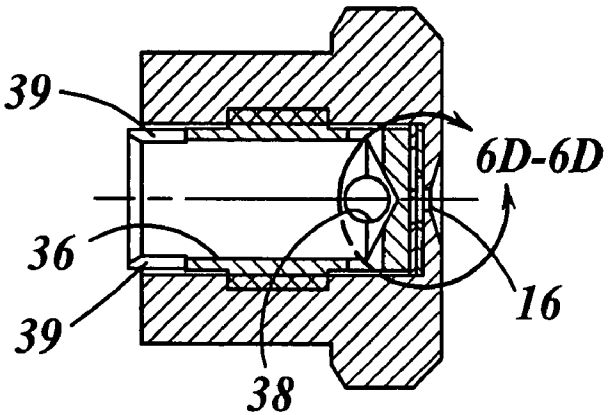
FIG. 6C is a cross-sectional view of the nozzle of FIG. 6A.
Figure 6D:
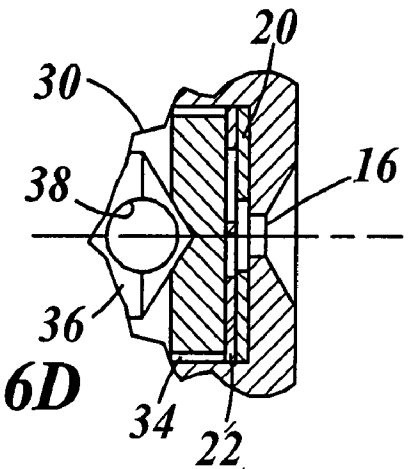
FIG. 6D is an enlarged partial cross-sectional view of the nozzle of FIG. 6C.
Figure 7:
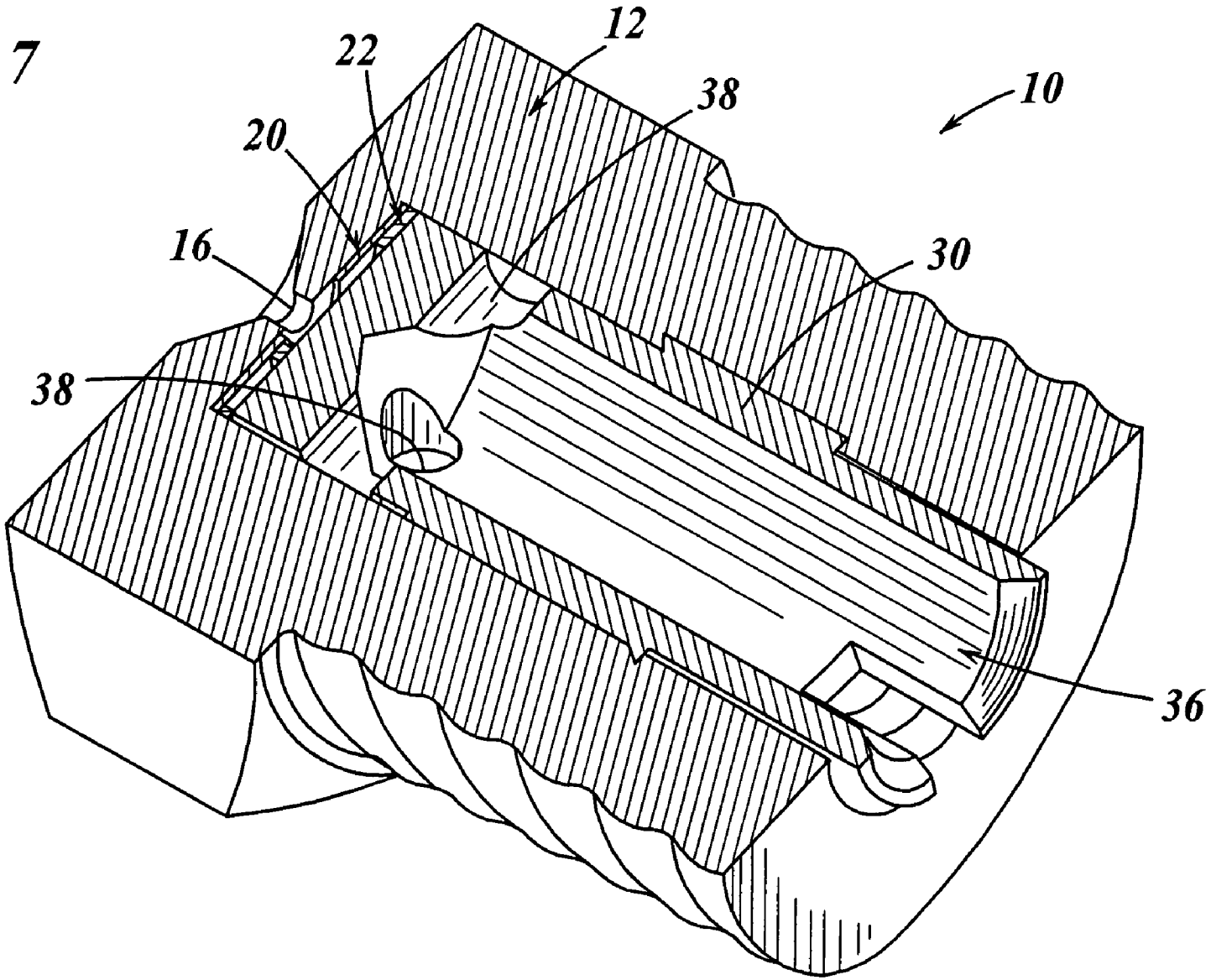
FIG. 7 is a perspective cross-sectional view of the nozzle of FIG. 6A.

Referring to FIGS. 5A-D, the plug 30 has an intermediate portion 32 for threadably engaging the inlet chamber 18 to retain the disks 20, 22 in place. Each end of the plug 30 is relatively narrower than the intermediate portion 32. As a result, when the plug 30 is inserted in the body 12 an annulus area 34 (see FIG. 6D) is formed between the plug 30 and body 12. The annulus area 34 is in fluid communication with the inlet 27 of the swirl disk 22 (FIG. 4A). The plug 30 has an internal bore 36 for conducting the fluid into the annulus area 34. A set of four exit orifices 38 are substantially equally spaced about the circumference of the plug 30 at the bottom of the internal bore 36 to allow the fluid to pass from the internal bore 36 to the annulus area 34. A pair of diametrically opposed, axially elongated slots 39 are formed in the end of the plug 30 opposite the exit orifices 38 for gripping by a tool, pick and place robot, or other devices for assembling the plug 30 to the body 12. As may be recognized by those of ordinary skill in the pertinent art based on the teachings herein, the plug may define any number of exit orifices, and the exit orifices may take any of numerous different shapes and/or may be located in any of numerous different locations as desired or otherwise as might be required by a particular application. Similarly, the gripping surface(s) defined by the slots 39 may take any of numerous different shapes and/or configurations for purposes of performing the functions of the slots as described herein.

In the illustrated embodiment of the present invention, the orifice disk 20 and swirl disk 22 are manufactured using a photochemical etching process of a type known to those of ordinary skill in the pertinent art that results in very thin, tight tolerance components preferably formed of stainless steel. One advantage of the photochemical machining process is that it allows the swirl and orifice disks to be etched from sheet material substrates in a manner that obtains sufficiently tight tolerances to produce extremely small droplet sizes that could not be achieved with certain prior art single fluid whirl nozzles (e.g., droplets with a Sauter Mean Diameter on the order of about 20 microns at about 1000 psi and at flow rates of less than or equal to about 0.05 gpm). Yet another advantage is that the photochemical machining process is a relatively efficient and low-cost method for producing large volumes of relatively tight tolerance components, such as the swirl and orifice disks. Exemplary etching techniques are shown in U.S. Pat. No. 5,740,967 to Simmons et al. and U.S. Pat. No. 5,951,882 to Simmons et al., each of which is incorporated herein by reference. It is also envisioned that the disks 20, 22 can be fabricated by any of numerous other techniques or processes that are currently or later become known, including metal injection molding, laser cutting, fine stamping, or a combination of any of numerous different processes and/or manufacturing techniques that are currently, or later become known, for manufacturing swirl and/or orifice disks of the type disclosed herein. For example, in one currently preferred embodiment of the present invention, the central aperture 24 of the orifice disk is formed by drilling. In this embodiment, the orifice disk aperture is formed by several drill passes including, e.g., a first pass of a drill to form a relatively rough aperture, and a second pass of a drill to remove any burrs and otherwise clean the periphery of the aperture. In addition, or in lieu of several drill passes, the drilled aperture can be cleaned by lapping or rubbing with or otherwise applying thereto an emery cloth or other device for removing burrs or otherwise cleaning metal surfaces. As may be recognized by those of ordinary skill in the pertinent art based on the teachings herein, for most, if not all applications, it is important that the periphery of the orifice disk aperture be burr free and otherwise define a substantially uniform, smooth and clean surface in order to obtain the desired flow characteristics. In addition, as also may be recognized by those of ordinary skill in the pertinent art based on the teachings herein, although the orifice and swirl disks 20 and 22, respectively, are etched from stainless steel sheets, these disks may be formed from any of numerous other types of metals or other materials that are currently or later become known for performing the functions of the respective disk, and/or as may be required by a particular application or as may be permitted by a particular manufacturing technique or process.

In one embodiment of the present invention, the thickness of the orifice disk is within the range of about 0.005 through about 0.02 inches, and in one example, the thickness of the orifice disk is about 0.005 inches. Also in this embodiment, the swirl disk defines a thickness within the range of about 0.005 through about 0.02 inches, and in one example, the thickness of the swirl disk is about 0.005 inches. In another embodiment of the present invention, the thickness of the orifice disk is within the range of about 0.005 through about 0.03 inches, more preferably is within the range of about 0.015 through about 0.025 inches, and in one example is about 0.02 inches. In this example, the thicker orifice disk (0.02 inches, as opposed 0.005 inches in the example above)

facilitates in preventing undesirable skewing of the spray pattern. Also in this embodiment, the swirl disk defines a thickness within the range of about 0.003 inches through about 0.03 inches, and more preferably, within the range of about 0.005 inches through about 0.015 inches. In one example, the thickness of the swirl disk is about 0.005 inches. Also in a currently preferred embodiment of the present invention, the swirl disk defines a diameter (or maximum width if non-circular) of at least about 0.1 inches. As indicated above, the thickness of the orifice disk can affect the spray pattern and/or other characteristics of the nozzle. Frequently, it is important to evaluate the thickness of the orifice disk ("L") in the context of the diameter of the orifice disk aperture ("D"). In the exemplary embodiment above, the thickness "L" of the orifice disk is about 0.02 inches, the diameter "D" is about 0.005 inches, and therefore L/D is about 4. In currently preferred embodiments of the present invention, the diameter D of the orifice disk aperture is within the range of about 0.005 inches through about 0.03 inches. Also in such currently preferred embodiments of the present invention, the LID ratio is preferably within the range of about 0.16 through about 6.

Referring to FIGS. 6A-D and 7, to assemble the nozzle 10, the orifice disk 20 is placed in the bottom of the inlet chamber 18. Similarly, the swirl disk 22 is placed directly adjacent to the orifice disk 20. In a currently preferred embodiment, the inner diameter of the body 12 and outer diameter of each disk 20, 22 are sized and configured such that each disk 20, 22 self-centers within the inlet chamber 18. One advantage of the orifice and swirl disks 20, 22 of the present invention is that because each disk is symmetrical (e.g., each disk is symmetrical about a plane perpendicular to its central axis), each disk is reversible, thereby alleviating the need for orientating a particular side up or down and further simplifying assembly. The plug 30 is then threadedly inserted into the inlet chamber 18 to press against the swirl disk 22. Although the plug 30 is threaded into the body 12, welding, pressing, staking, swaging or like methods may be used to insure that the plug 30, and thereby the disks 20, 22, are retained.

In operation, the nozzle 10 is mounted on a pipe or other structure such that liquid enters the internal bore 36 of the plug 30. The liquid exits the internal bore 36 via the set of exit orifices 38. Accordingly, the liquid travels into the annulus area 34 substantially perpendicularly to the axis of the nozzle 10. The annulus area 34 is in fluid communication with the inlet 27 at the periphery of the swirl disk 22 so that the liquid within the annulus area 34 enters the inlet 27 of the swirl disk 22. As the liquid passes through the throat 26 of the inlet 27, the liquid enters the central aperture or swirl chamber 28 of the swirl disk 22 where a vortex is formed. Then, the liquid passes through the central aperture 24 of the orifice disk 20 and out of the outlet 16 of the body 12. Upon exiting the body 12, the turbulence of the swirling vortex forces the liquid to disintegrate into a fine mist.

Figure 8:
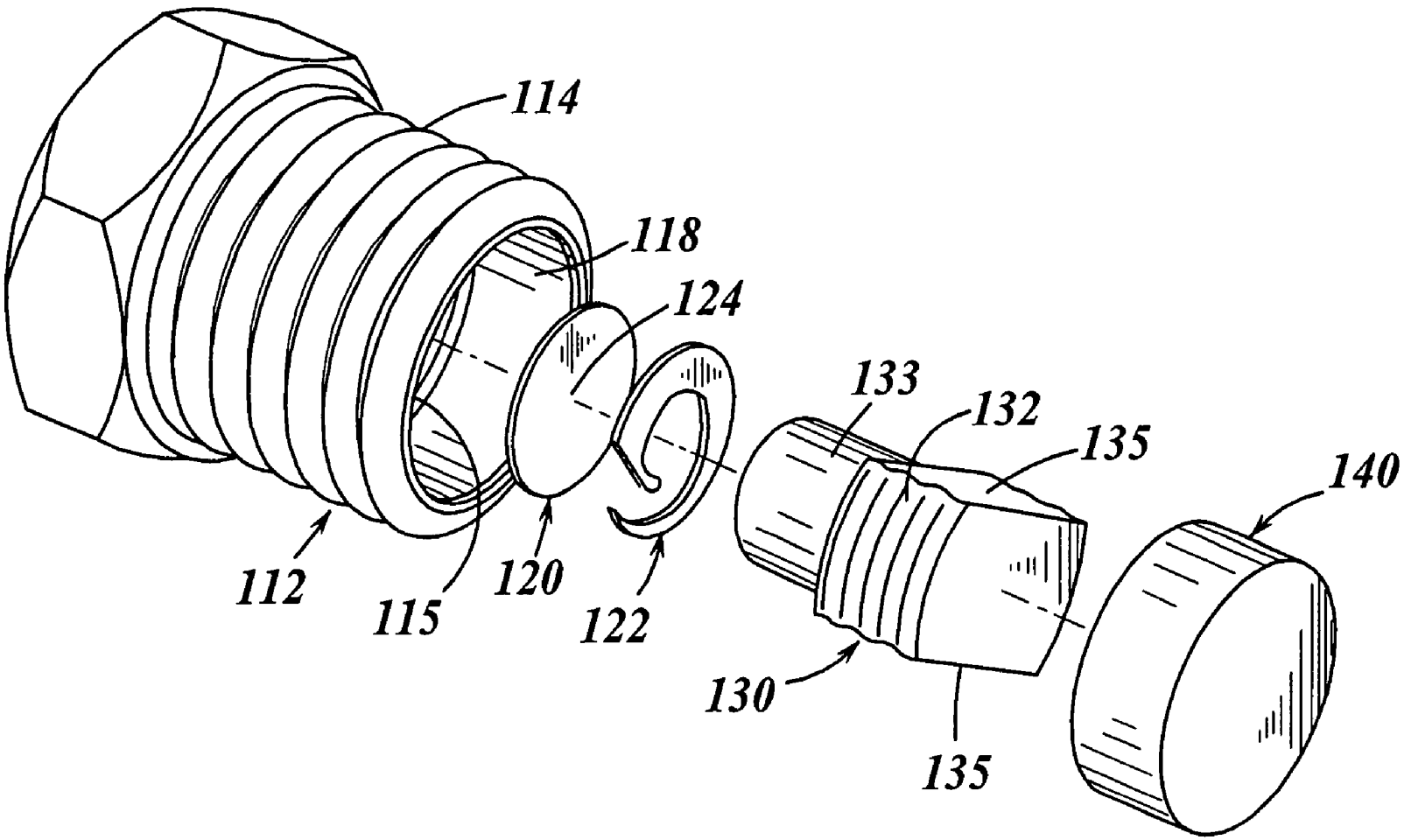
FIG. 8 is a perspective exploded view of another nozzle embodying the present invention.
Figure 9A:
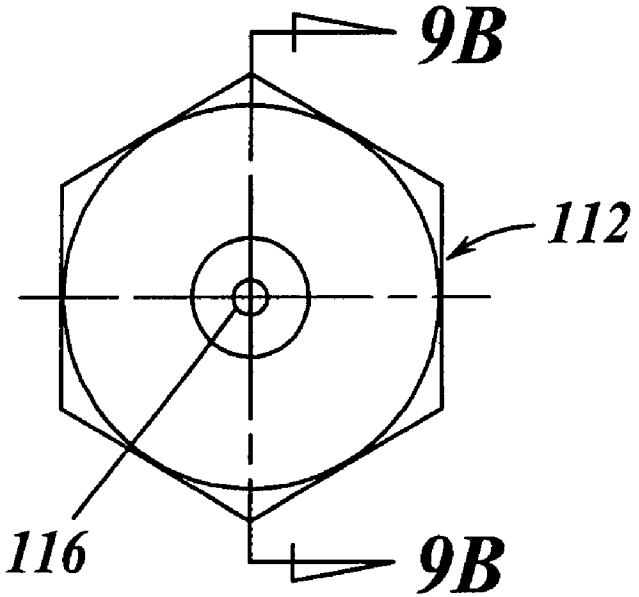
FIG. 9A is an end view of a body for the nozzle of FIG. 8.
Figure 9B:
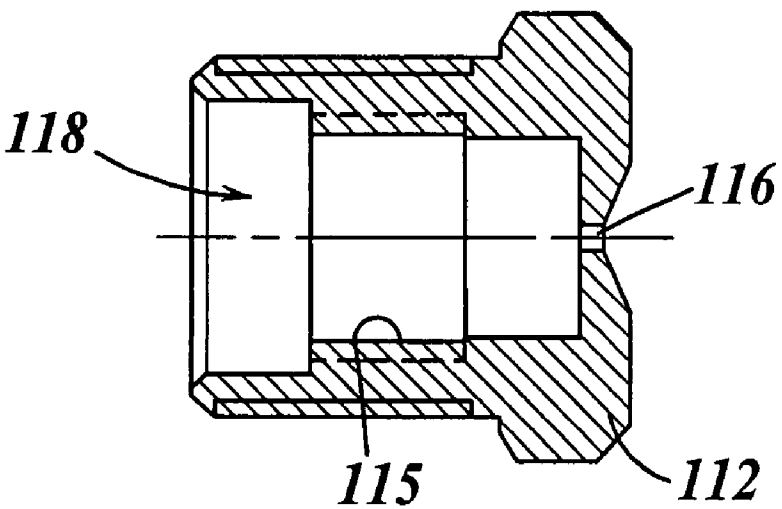
FIG. 9B is a cross-sectional view of the body for the nozzle of FIG. 8.

Referring to FIG. 8, an exploded view of a nozzle referred to generally by reference numeral 110 is shown. As will be appreciated by those of ordinary skill in the pertinent art, the nozzle 110 utilizes many of the same principles as the nozzle 10 described above. Accordingly, like reference numerals preceded by the numeral "1" are used to indicate like elements. The nozzle 110 has a body 112 for engaging a pipe or other structure (not shown) by a threaded end 114. Now also referring to FIGS. 9A and 9B, the body 112 defines an outlet 116 at the nose of the body 112 for discharging the liquid. An inlet chamber 118 is formed in the body 112 for receiving an orifice disk 120, a swirl disk 122, a plug 130 and filter 140. An intermediate portion 115 of the inlet chamber 118 defines threads for engaging the plug 130 which retains the disks 120, 122 in place. At the threaded end 114, the inlet chamber 118 has a relatively larger inner diameter for receiving the filter 140 in a press fit manner. Preferably, the filter 140 is a porous filter which causes minimal pressure drop.

Figure 10A:
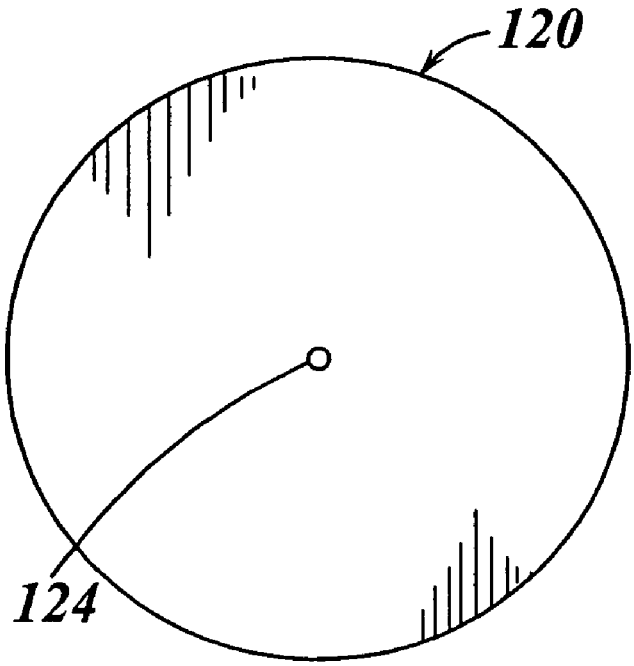
FIG. 10A is a front view of an orifice disk for the nozzle of FIG. 8.
Figure 10B:
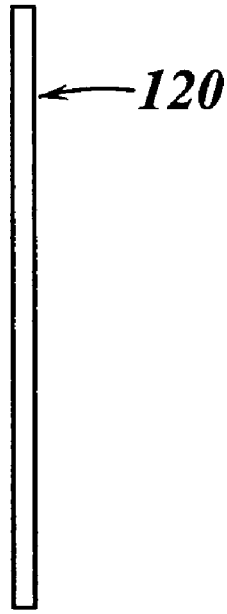
FIG. 10B is a side view of the orifice disk for the nozzle of FIG. 8.
Figures 11A, 11B:
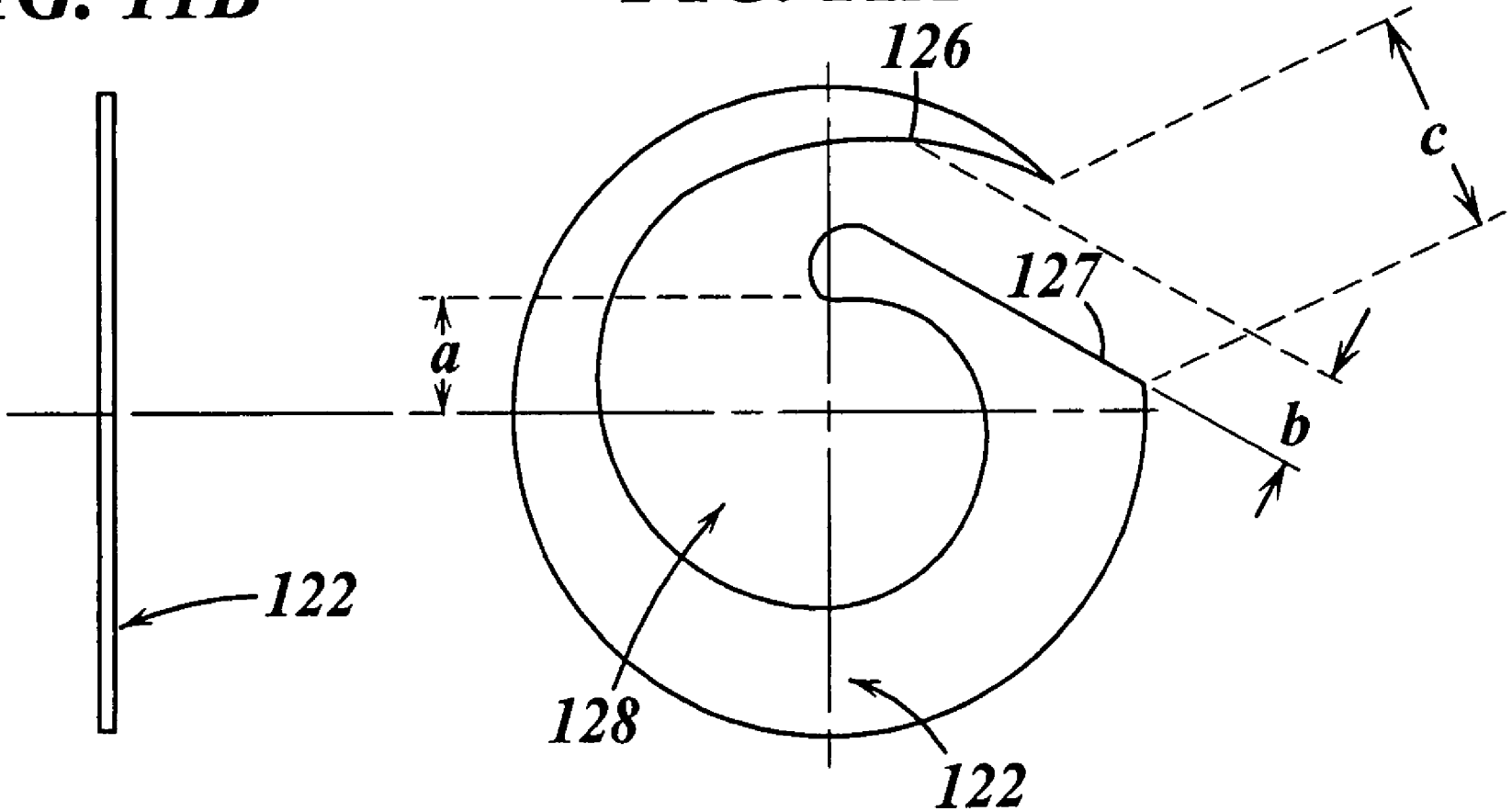
FIG. 11A is a front view of a swirl disk for the nozzle of FIG. 8.
FIG. 11B is a side view of the swirl disk for the nozzle of FIG. 8.

Referring to FIGS. 10A and 10B, the orifice disk 120 has a central aperture 124 and is placed in the bottom of the inlet chamber 118 so that the central aperture 124 is adjacent to and axially aligned with the outlet 116 of the body 112. Referring to FIGS. 11A and 11B, the swirl disk 122 creates a vortex within a substantially central hollow or swirl chamber 128 defining a start radius "a". The swirl disk 122 is placed adjacent to the orifice disk 120 in the inlet chamber 118 so that the central hollow 128 is adjacent to and axially aligned with the central aperture 124. The swirl disk 122 also forms an inlet 127 in fluid communication with the central hollow 128 for channeling fluid thereto. The inlet 127 expands gradually from a throat 126 having a width "b" to an entry width "c" at the periphery of the swirl disk 122. Among other parameters, the throat ratio, which is the throat "b" divided by the start radius "a", controls the tightness of the vortex formed in the central hollow 128 and, thereby, affects the performance of the nozzle 110. U.S. Pat. No. 3,771,728 details several additional parameters which may be varied to modify the shape of the vortex and is hereby expressly incorporated by reference as part of the present disclosure.

Figure 12B:
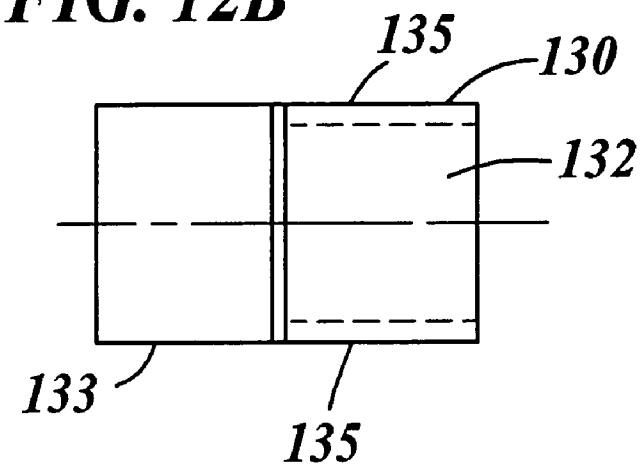
FIG. 12B is a side view of the plug for the nozzle of FIG. 8.
Figure 12A:
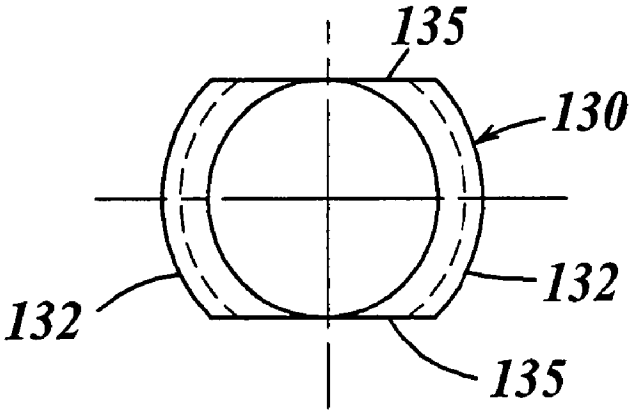
FIG. 12A is an end view of the plug for the nozzle of FIG. 8.
Figure 12C:
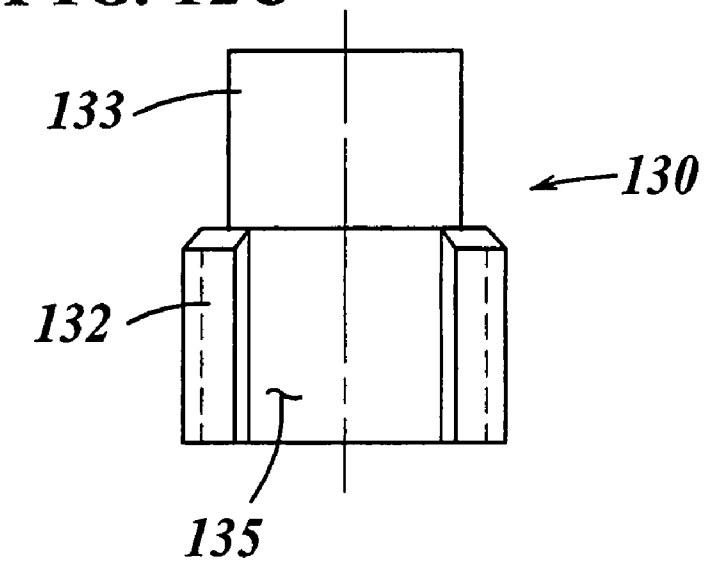
FIG. 12C is another side view of a plug for the nozzle of FIG. 8.
Figure 13A:
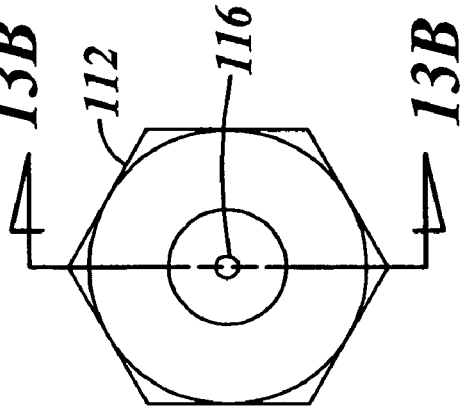
FIG. 13A is an end view of the nozzle of FIG. 8 in an assembled state.
Figure 13B:
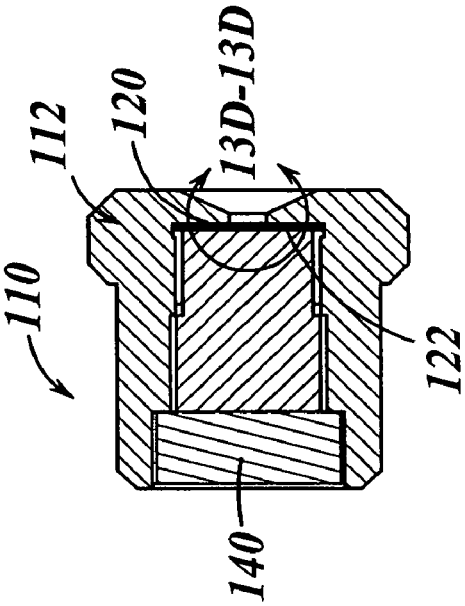
FIG. 13B is a cross-sectional view of the nozzle of FIG. 13A.
Figure 13C:
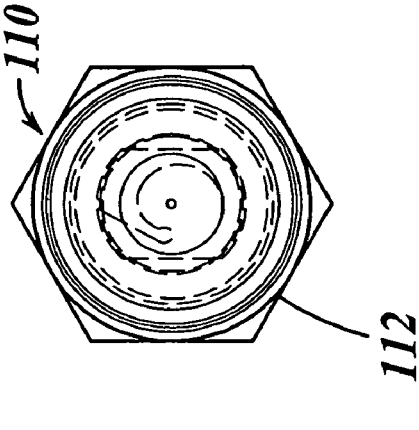
FIG. 13C is another end view of the nozzle of FIG. 13A.
Figure 13D:
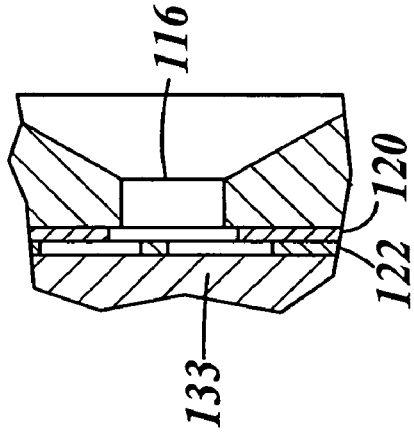
FIG. 13D is an enlarged partial, cross-sectional view of the nozzle of FIG. 13A.
Figure 13E:
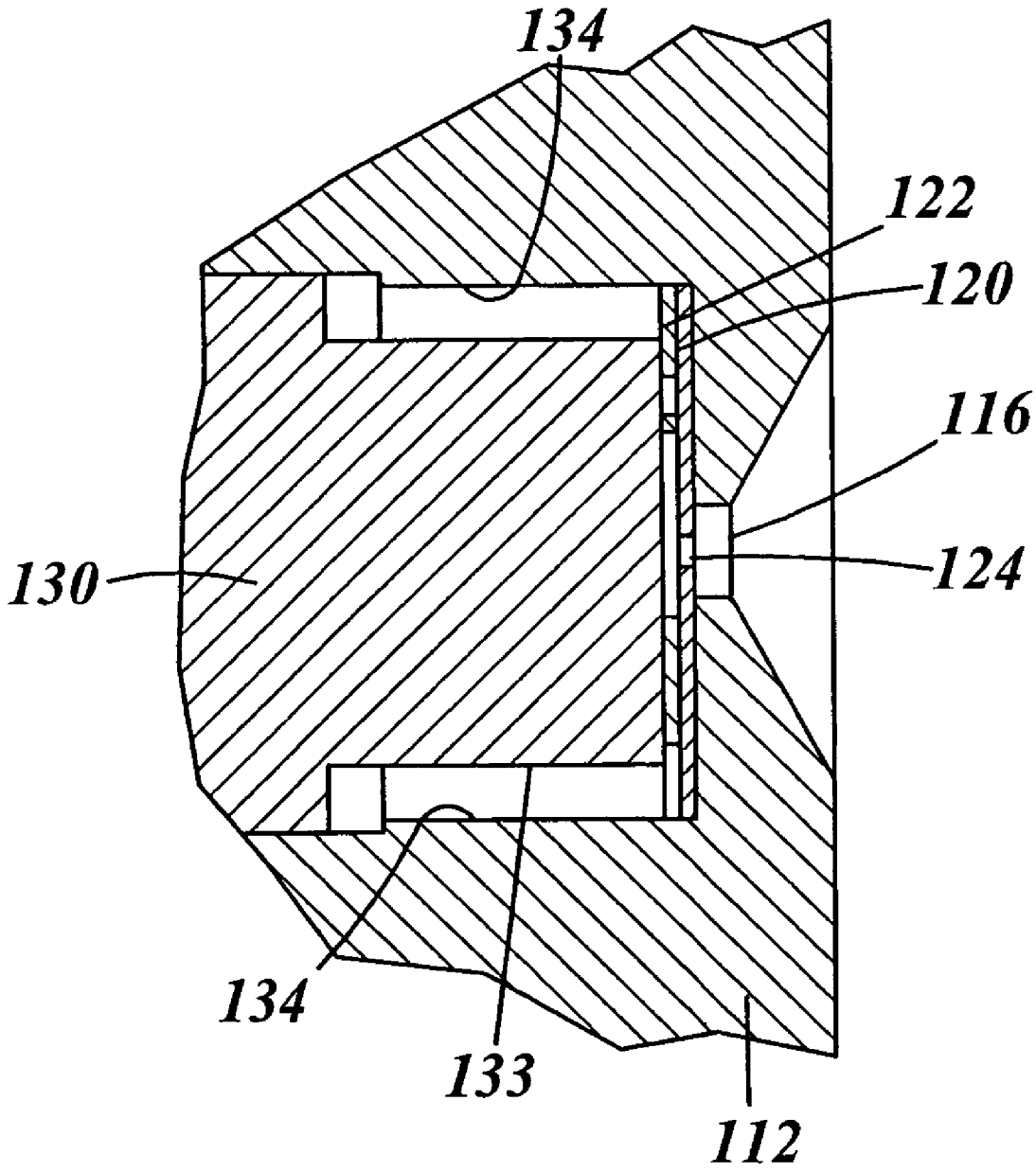
FIG. 13E is another enlarged partial, cross-sectional view of the nozzle of FIG. 13A.

Referring to FIGS. 12A-C, the plug 130 has a threaded proximal portion 132 for engaging the inlet chamber 118 to retain the disks 120, 122. The distal end 133 of the plug 130 is relatively narrower in radius than the intermediate portion 132. As a result of the narrower distal end 133, when the plug 130 is inserted into the body 112, an annulus area 134 (see FIG. 13E) is formed between the plug 130 and body 112. The annulus area 134 allows the fluid to pass into the inlet 127 of the swirl disk 122. The proximal portion 132 forms two flats 135 for allowing fluid to pass between the plug 130 and body 112 and into the annulus area 134. The flats 135 also are engageable by a tool, pick and place robot, or other device for assembling the nozzle 110.

Referring to FIGS. 13A-E, to assemble the nozzle 110, the orifice disk 120 is placed in the bottom of the inlet chamber 118. Similarly, the swirl disk 122 is placed directly adjacent to the orifice disk 120. In a preferred embodiment, the inner diameter of the inlet chamber 118 of the body 112 and outer diameter of each disk 120, 122 are sized and configured such that each disk 120, 122 self-centers within the inlet chamber 118. The plug 130 is then threadedly inserted into the inlet chamber 118 to press against the swirl disk 122 and thereby retain the orifice disk 120 against the outlet 116. Although the plug 130 is threaded into the body 112, welding, pressing, staking, swaging or like methods may be used to insure the plug 130 is fixed in place. Upon securing the plug 130, the filter 140 is press fit into the large diameter portion of the inlet chamber 118 at the threaded end 114.

In operation, the liquid enters the nozzle 110 via the filter 140 and passage formed between the flats 135 of the plug 130 and the body 112. The annulus area 134 collects the liquid passing beyond the flats 135. The annulus area 134 is in fluid communication with the inlet 127 at the periphery of the swirl disk 122 so that the liquid within the annulus area 134 enters the inlet 127. As the liquid passes through the inlet 127, the liquid enters the central aperture 128 of the swirl disk 122 where a vortex is formed. Then, the liquid passes through the central aperture 124 of the orifice disk 120 and exits from the outlet 116 of the body 112 where the kinetic energy of the liquid causes the liquid to disintegrate into a mist.

Table 1 below illustrates exemplary results of experiments conducted with nozzles embodying the present invention. During testing, it was determined that a tighter vortex within the swirl chamber yields comparatively better results in terms of droplet size and spray pattern. Also, it was determined that axial misalignment of the orifice disk with respect to the swirl disk skewed the spray pattern. Due to the symmetry of the disks 120, 122, neither disk 120, 122 has an impact upon performance when reversed. Thus, assembly of the nozzle 110 is simplified because neither disk 120, 122 has an "up" or a "down" side as the disks 120, 122 are placed in the nozzle 110.

With reference to Table 1, the "pressure" column indicates the pressure (in psi) of the fluid flowing into the nozzle. The "orifice diameter" is the diameter (in inches) of the spray orifice 24, 124. As shown, for example, in FIG. 11B, the "swirl start radius" is the start radius "a" (in inches), and the "throat ratio" is the throat width "b" of the inlet 127 divided by the swirl start radius "a". The "D32" column in Table 1 represents the Sauter Mean drop size. The "DV0.9" column represents a droplet diameter of the spray emitted by the nozzle such that 90% of the total volume (or mass) is composed of droplets with diameters less than the "DV0.9" diameter. The "mass" column represents in kilograms the amount of liquid collected during the collection time in minutes. The "flow" in gallons/minute is the mass divided by the collection time. Lastly, the "K-factor" column indicates an industry standard figure of merit that is proportional to flow, in which a higher number indicates a higher flow nozzle and a lower number indicates a lower flow nozzle for a given pressure.

A significant advantage of the currently preferred embodiments of the present invention is that the nozzle can produce very small droplets without requiring very high pressures. For example, in turbine cooling applications, the nozzles of the present invention are capable of achieving acceptable droplet sizes at about 1,000 psi, whereas certain prior art nozzles may require pressures of 3,000 psi or higher to achieve comparable results. As a result, a system employing the nozzles of the present invention is capable of operating at lower pressures then permitted by certain prior art nozzles, thus permitting lower initial costs associated with pump skids as well as lower operating costs associated with the pumping systems. It is currently believed that one reason why the nozzles of the present invention are capable of achieving such improved results is the ability to make the swirl chamber relatively small, and particularly the throat distance of the swirl chamber relatively small in comparison to prior art nozzles. In currently preferred embodiments of the present invention, the start radii are preferably within the range of about 0.02 inches through about 0.04 inches, and the throat ratios (i.e., the throat width divided by the swirl start radius) are within the range of about 0.6 through about 1.1. Yet another advantage of the present invention is that because the swirl chamber is formed in a disk having a sheet material substrate that may be machined by, for example, the above-described photochemical etching process, the swirl chamber can be made relatively small while nevertheless accurately maintaining relatively tight tolerances. As a result, the nozzles of the present invention are capable at a given pressure of more effectively and efficiently translating the pressurized fluid into smaller droplets than certain prior art nozzles.

TABLE 1

| pressure | orifice diameter | swirl start radius | throat ratio | D32 | DV0.9 | Mass | collection time | flow | K-factor * 10^4 |
|---|---|---|---|---|---|---|---|---|---|
| 1000 | 0.006 | 0.03 | 0.85 | 25.2 | 44.6 | 0.111 | 2 | 0.014663 | 4.6368933 |
| 1000 | 0.013 | 0.02 | 0.85 | 17.8 | 31 | 0.1105 | 1 | 0.029194 | 9.2320127 |
| 1000 | 0.013 | 0.03 | 0.6 | 16.6 | 28.4 | 0.102 | 1 | 0.026948 | 8.5218579 |
| 1000 | 0.013 | 0.03 | 1.1 | 25.9 | 48.9 | 0.2205 | 2 | 0.029128 | 9.2111258 |
| 1000 | 0.013 | 0.04 | 0.85 | 33.6 | 49 | 0.1295 | 1 | 0.034214 | 10.819418 |
| 1000 | 0.02 | 0.03 | 0.85 | 40.6 | 62.8 | 0.2495 | 1 | 0.065918 | 20.845133 |
| 2000 | 0.006 | 0.02 | 0.85 | 22.6 | 38.8 | 0.1815 | 2 | 0.023976 | 5.3612462 |
| 2000 | 0.006 | 0.03 | 0.6 | 17.8 | 33.9 | 0.133 | 2 | 0.017569 | 3.9286267 |
| 2000 | 0.006 | 0.03 | 1.1 | 23.6 | 39.1 | 0.126 | 2 | 0.016645 | 3.7218569 |
| 2000 | 0.006 | 0.04 | 0.85 | 20.7 | 37.1 | 0.147 | 2 | 0.019419 | 4.3421664 |
| 2000 | 0.013 | 0.02 | 0.6 | 19.3 | 34.9 | 0.146 | 1 | 0.038573 | 8.6252556 |
| 2000 | 0.013 | 0.02 | 1.1 | 21.3 | 38.6 | 0.1835 | 1 | 0.048481 | 10.840647 |
| 2000 | 0.013 | 0.03 | 0.85 | 19.6 | 39.5 | 0.181 | 1 | 0.04782 | 10.692954 |
| 2000 | 0.013 | 0.03 | 0.85 | 17.4 | 31.1 | 0.183 | 1 | 0.048349 | 10.811108 |
| 2000 | 0.013 | 0.03 | 0.85 | 32.9 | 50.2 | 0.1595 | 1 | 0.04214 | 9.4227964 |
| 2000 | 0.013 | 0.04 | 0.6 | 23.8 | 44.9 | 0.156 | 1 | 0.041215 | 9.2160265 |
| 2000 | 0.013 | 0.04 | 1.1 | 32.5 | 50 | 0.1705 | 1 | 0.045046 | 10.072644 |
| 2000 | 0.02 | 0.02 | 0.85 | 29.7 | 49 | 0.2665 | 1 | 0.07041 | 15.744045 |
| 2000 | 0.02 | 0.03 | 0.6 | 16.9 | 28.8 | 0.267 | 1 | 0.070542 | 15.773584 |
| 2000 | 0.02 | 0.03 | 1.1 | 27.4 | 48.7 | 0.2815 | 1 | 0.074373 | 16.630202 |
| 2000 | 0.02 | 0.04 | 0.85 | 32.4 | 54.1 | 0.273 | 1 | 0.072127 | 16.128046 |
| 3000 | 0.006 | 0.03 | 0.85 | 23.6 | 40.1 | 0.194 | 2 | 0.025627 | 4.6789157 |
| 3000 | 0.013 | 0.02 | 0.85 | 27.9 | 46.7 | 0.213 | 1 | 0.056275 | 10.27432 |
| 3000 | 0.013 | 0.03 | 0.6 | 29 | 47.8 | 0.1985 | 1 | 0.052444 | 9.5748946 |
| 3000 | 0.013 | 0.03 | 1.1 | 27.6 | 44.6 | 0.2145 | 1 | 0.056671 | 10.346675 |
| 3000 | 0.013 | 0.04 | 0.85 | 22.5 | 38.2 | 0.2155 | 1 | 0.056935 | 10.394911 |
| 3000 | 0.02 | 0.03 | 0.85 | 31.6 | 48.9 | 0.2865 | 1 | 0.075694 | 13.819684 |
| 3000 | 0.013 | 0.02 | 0.85 | 27.5 | 59.4 | 0.1985 | 1 | 0.052444 | 9.5748946 |
| 3000 | 0.013 | 0.02 | 0.85 | 24.2 | 45.9 | 0.1884 | 1 | 0.049775 | 9.0877085 |
| 3000 | 0.013 | 0.02 | 0.85 | 28 | 47.5 | 0.2095 | 1 | 0.05535 | 10.105493 |
| 1000 | 0.013 | 0.02 | 0.85 | 17.8 | 34.2 | 0.113 | 1 | 0.029855 | 9.4408818 |
| 1000 | 0.013 | 0.02 | 0.85 | 17.4 | 31.1 | 0.115 | 1 | 0.030383 | 9.607977 |

Figure 14:
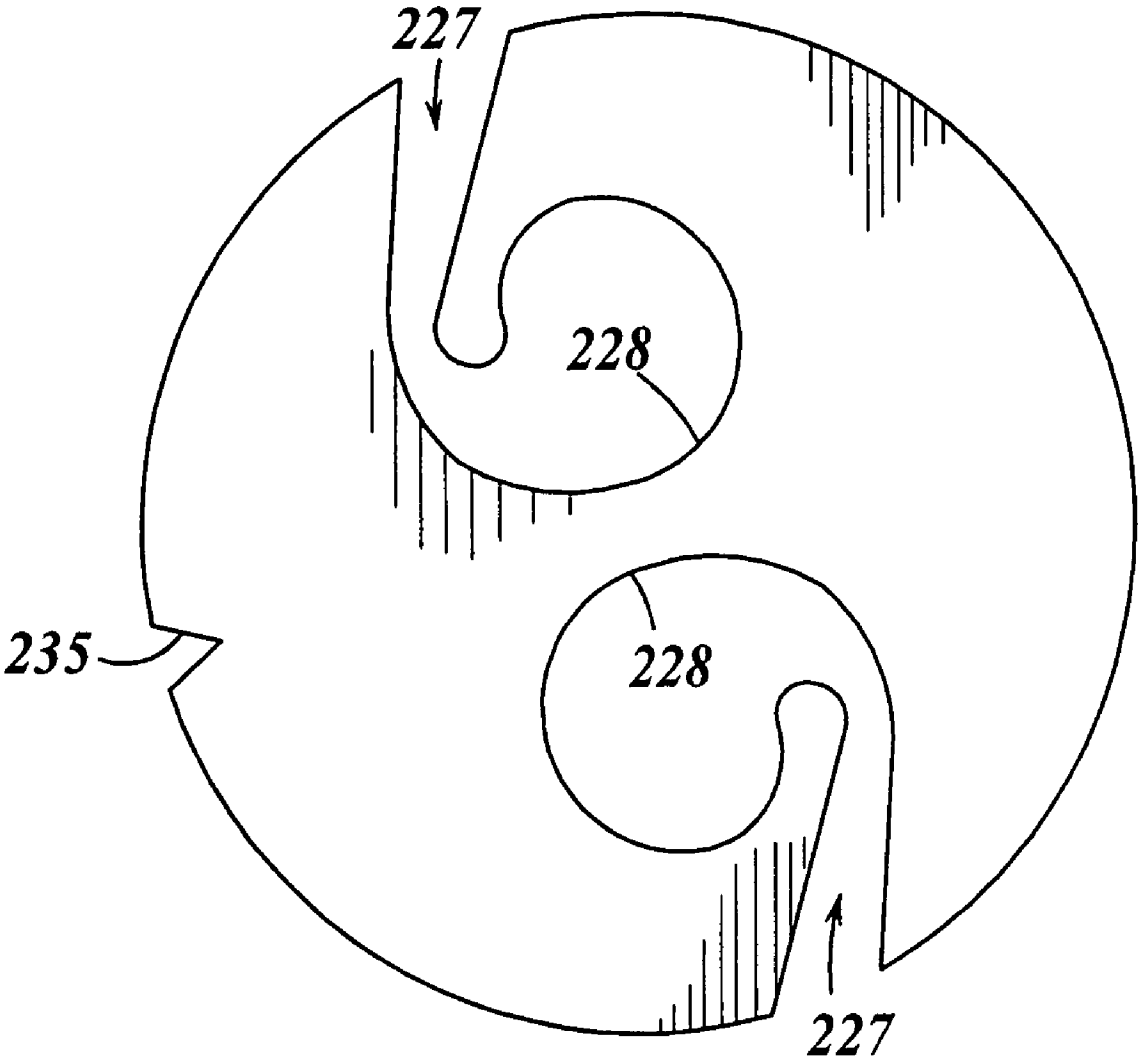
FIG. 14 is a front view of another embodiment of a swirl disk of the present invention.
Figure 15:
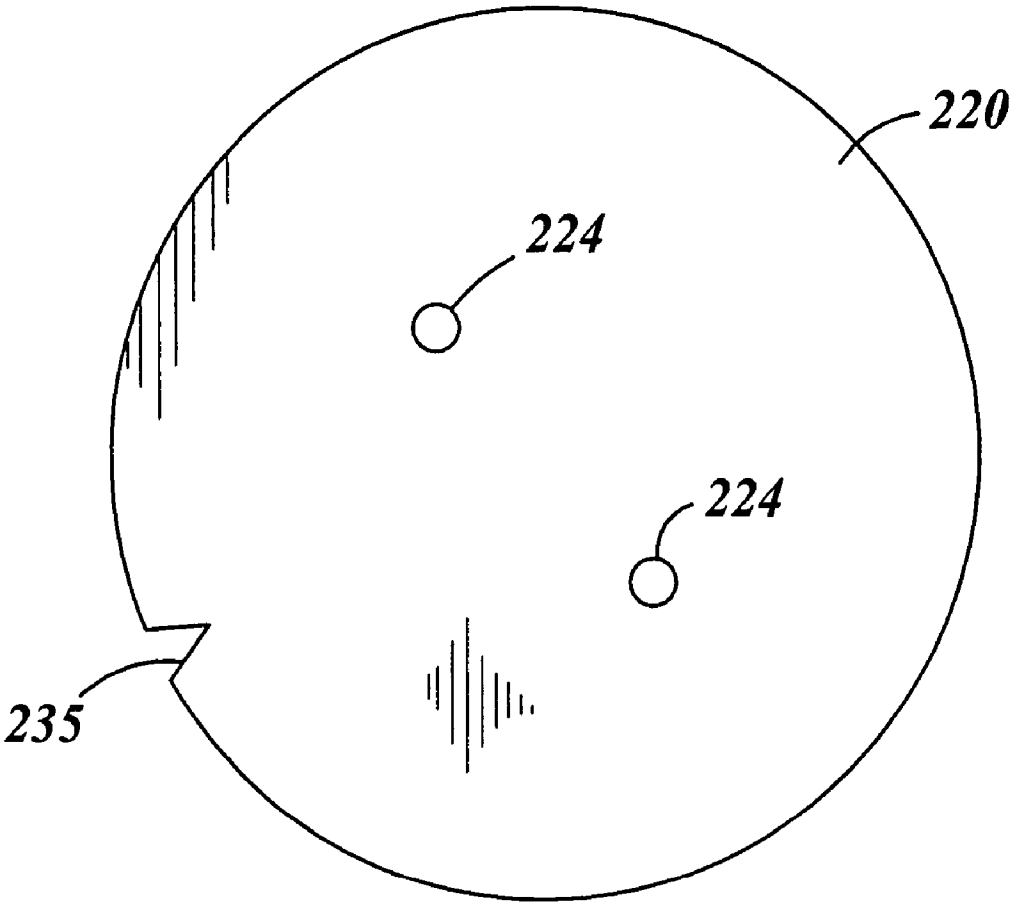
FIG. 15 is a front view of another embodiment of an orifice disk of the present invention for use with the swirl disk of FIG. 14.

Referring to FIGS. 14 and 15, an orifice disk 220 and a swirl disk 222 may have a plurality of paths through which a liquid may travel. As will be appreciated by those of ordinary skill in the pertinent art, the disks 220, 222 utilize many of the same principles as the disks 120, 122 described above. Accordingly, like reference numerals preceded by the numeral "2", or preceded by the numeral "2" instead of the numeral "1", are used to indicate like elements. The orifice disk 220 has two spray apertures 224. The orifice disk is received within a retaining body (not shown) in the same manner as the orifice disks described above such that each spray aperture 224 is axially aligned with and adjacent to a respective outlet formed in the retaining body to discharge the nozzle spray therethrough. The swirl disk 222 defines a pair of hollows 228 that form swirl chambers for creating vortexes of liquid therein. The swirl disk 222 is placed adjacent to the orifice disk 220 within the retaining body so that the hollows 228 are located adjacent to and axially aligned with the respective spray apertures 224. The swirl disk 222 also defines a pair of inlets 227, wherein each inlet is connected in fluid communication with the respective hollow 228 for channeling fluid thereto. In the illustrated embodiment, each of the disks 220, 222 forms a notch 235 for receiving a protrusion on the retaining body (not shown) such that receipt of the protrusion(s) within the notch(es) aligns the spray apertures 224 of the orifice disk with the hollows 228 of the swirl disk and the outlets of the retaining body (not shown).

As may be recognized by those of ordinary skill in the pertinent art based on the teachings herein, the orifice disks may define any desired number of spray orifices, the swirl disks may define any desired number of swirl chambers, and the orifices and swirl chambers may be located as desired within the respective disks. In addition, the retaining body may define a common fluid inlet for all swirl chambers and spray orifices, or may define separate fluid inlets for separate swirl chambers and spray orifices, or for separate groups of swirl chambers and spray orifices. In addition, the retaining body may define a plurality of outlet apertures, wherein each outlet aperture is aligned with a respective spray orifice of the orifice disk, or may define a lesser number of outlet apertures than spray orifices such that all spray orifices discharge through a common outlet aperture, or a group of spray orifices discharge through a common outlet aperture. Also, the retaining body may define a manifold having formed therein a plurality of recesses, wherein each recess is adapted to receive a respective orifice disk and swirl disk, and the retaining body may define a common plug or other retaining device, or may define a plurality of plugs or other retaining devices, for fixedly securing the orifice disks and swirl disks to the manifold. In addition, the plug or other retaining device may define a common fluid inlet for all swirl chambers, or may define separate fluid inlets for separate swirl chambers or groups of swirl chambers.

Figure 16:
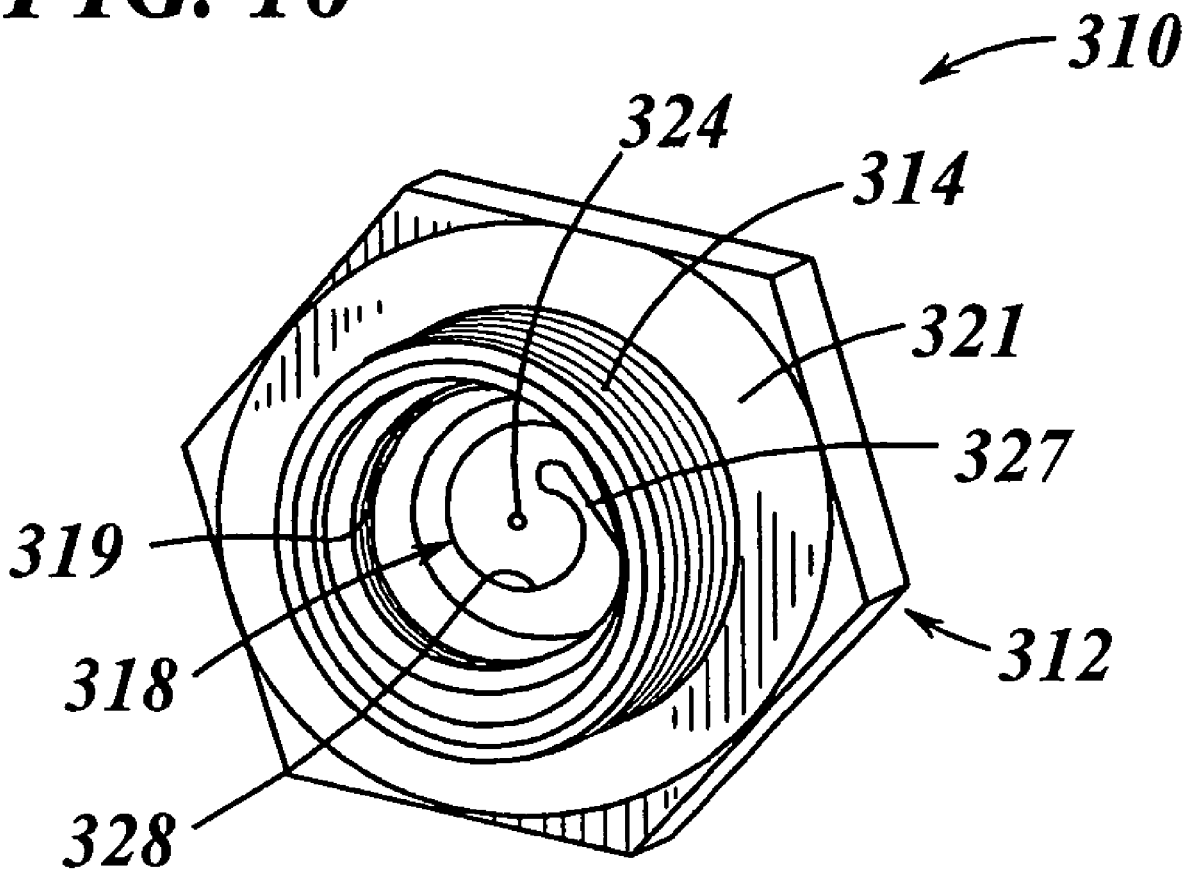
FIG. 16 is a perspective view of another nozzle embodying the present wherein the body of the nozzle is formed by metal injection molding ("MIM") and the swirl chamber and spray orifice are formed integral with the body instead of being formed by separate disks as in the embodiments described above.
Figure 17C:
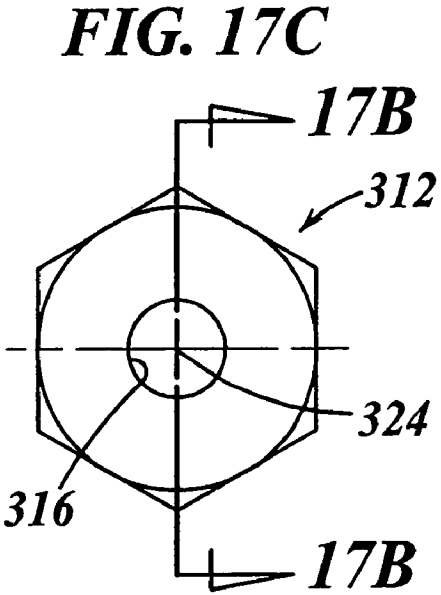
FIG. 17C is an end view of the body of FIG. 16.
Figure 17B:
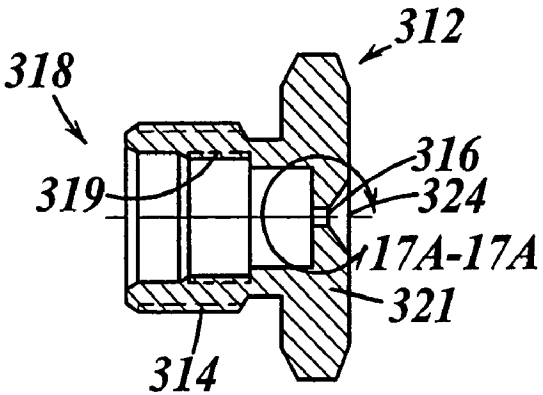
FIG. 17B is a cross-sectional view of the body of FIG. 16.
Figure 17A:
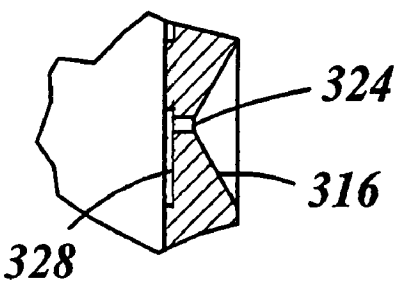
FIG. 17A is an enlarged partial, cross-sectional view of the body of FIG. 16.
Figure 17D:
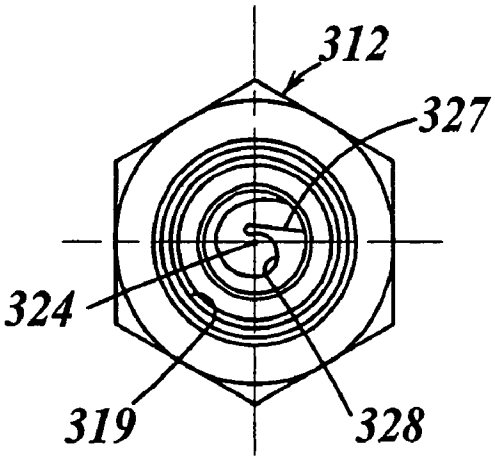
FIG. 17D is another end view of the body of FIG. 16.
Figure 17E:
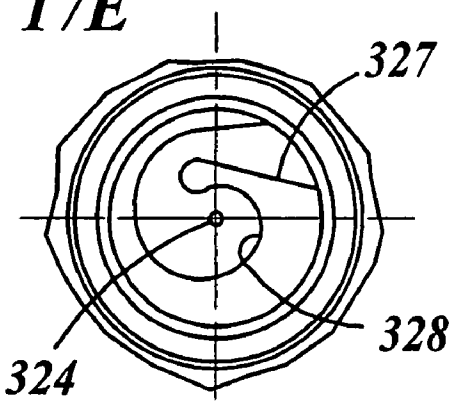
FIG. 17E is an enlarged partial end view of the body of FIG. 16.

Referring to FIGS. 16-17E, another nozzle in accordance with the subject invention is referred to generally by reference numeral 310. As will be appreciated by those of ordinary skill in the pertinent art, the nozzle 310 utilizes many of the same principles as the nozzles described above. Accordingly, like reference numerals preceded by the numeral "3", or preceded by the numeral "3" instead of the numerals "2" or "1", are used to indicate like elements. In a currently preferred embodiment, the body 312 of the nozzle 310 is manufactured by metal injection molding ("MIM"). Metal injection molding starts with combining a metal powder with a binder. The metal powder/binder mixture is injected into a mold cavity and sintered within the mold cavity to form the finished body 312. One advantage of using metal injection molding is that the body 312 requires no polishing, assembly and/or alignment of, for example, a swirl unit or orifice plate, because the swirl chamber(s) and spray orifice(s) are formed integral with the body.

The body 312 includes a threaded end 314 for engaging a pipe or other structure (not shown). The body 312 also defines an inlet chamber 318 and a threaded portion 319 for threadedly receiving within the inlet chamber a plug (not shown). The plug 318 may be the same as either of the plugs 30, 130 described above, or may define a different configuration. In either case, the plug need not perform the function of retaining a swirl disk and orifice disk within the body, but rather need only function to define a fluid flow path between the fluid inlet and the swirl chamber. The end wall 321 of the body defines a spray aperture 324 extending therethrough, a spray outlet 316 formed on one side of the spray orifice, and a recessed hollow 328 formed on the opposite side of the spray orifice and defining a swirl chamber connected in fluid communication with the spray orifice. A recessed inlet 327 is also formed on the interior side of the end wall 321 of the body and defines a inlet for channeling fluid into the swirl chamber. As can be seen, the swirl chamber 328 and swirl inlet 327 are virtually identical to the swirl chamber and inlet formed in the swirl disk 122 as shown in FIG. 11A.

Assembling the nozzle 310 is a relatively simple procedure requiring: 1) insertion of the plug and filter, if required (not shown) into the inlet chamber 318; and 2) attachment of the threaded end 314 of the body 312 to a pipe. In operation, the fluid flows through the plug, into the annulus formed between the inner end of the plug and the body, and into the inlet 327 of the swirl chamber. In the swirl chamber 328, the swirling fluid forms a vortex and is, in turn, discharged in a spray through the spray orifice 316 and out of the nozzle.

While the invention has been described with respect to preferred embodiments, those skilled in the art will readily appreciate that various changes and/or modifications can be made to the invention without departing from the spirit or scope of the invention. For example, the swirl chamber may be an integral piece of the end of the plug. A plurality of nozzles embodying the present invention may be mounted into a manifold, such as by threadedly mounting each nozzle to the manifold, to create a plurality of nozzles in close proximity to each other that utilize the same fluid source. Alternatively, each nozzle may utilize a different fluid inlet, or respective groups of nozzles may utilize common inlets. In addition, the nozzles of the present invention, including the swirl disks and/or orifice disks of such nozzles, may be made of any of numerous different materials that are currently or later become known for performing the functions of the nozzles, or the respective components of the nozzles. In addition, the components of the nozzles, including the bodies, swirl disks, orifice disks, and plugs, may take any of numerous different shapes and/or configurations that might be desired or otherwise required for a particular application. Further, the swirl chambers and inlets to the swirl chambers may take any of numerous different configurations that are currently or later become known. In yet another alternative embodiment of the present invention, the spray orifice may be formed in the end wall of the body as shown in FIG. 16, and the swirl chamber may be formed by a separate swirl disk, such as the swirl disk 22, 122, or 222. In another embodiment of the present invention, the swirl disk and/or orifice disk are surface treated with one or more wear-resistant coatings, such as a diamond coating or Titanium Nitride, in order to improve wear life. Accordingly, this detailed description of preferred embodiments is to be taken in an illustrative as opposed to a limiting sense.

What is claimed is:

1. A spray nozzle comprising:

a swirl disk formed of a sheet material substrate defining a thickness within the range of about 0.003 inch to about 0.03 inch, an etched peripheral edge, an etched first region spaced inwardly relative to the etched peripheral edge and forming a first aperture extending through the first region and defining a swirl chamber, and an etched second region extending between the swirl chamber and peripheral edge and defining a second aperture extending through the second region forming a swirl inlet to the swirl chamber;

an orifice disk formed of a sheet material substrate defining a thickness within the range of about 0.005 inch to about 0.03 inch, an etched peripheral portion defining a peripheral edge, and an etched first region spaced inwardly relative to the peripheral edge and defining a first aperture extending through the first region and forming a spray orifice;

a retaining body defining an inlet aperture and an outlet aperture; and a retaining member receivable within the retaining body;

wherein at least one fluid passageway is formed between the inlet aperture of the retaining body and the swirl inlet to the swirl chamber; the orifice disk is positioned within the retaining body with the spray orifice aligned with and adjacent to the outlet aperture of the retaining body; the swirl disk is positioned within the retaining body upstream of and contiguous to the orifice disk with the swirl chamber aligned and in fluid communication with the spray orifice of the orifice disk; and the retaining member is positioned within the retaining body in engagement with an opposite side of the swirl disk relative to the orifice disk to secure the retaining member, the orifice disk and swirl disk within the retaining body.

2. A spray nozzle as defined in claim 1, wherein the swirl disk further defines a first substantially planar surface on one side of the swirl disk, and a second substantially planar surface on an opposite side of the swirl disk.

3. A spray nozzle as defined in claim 2, wherein the first and second surfaces are substantially symmetrical about a plane approximately perpendicular to an axis of the swirl disk.

4. A spray nozzle as defined in claim 3, wherein the first and second surfaces of the swirl disk are substantially identical.

5. A spray nozzle as defined in claim 1, wherein at least one of the surfaces of the swirl disk includes a wear-resistant coating.

6. A spray nozzle as defined in claim 1, wherein at least one surface of the orifice disk includes a wear-resistant coating.

7. A spray nozzle as defined in claim 1, wherein the swirl disk defines a throat formed between the swirl inlet and swirl chamber, the swirl chamber defines a start radius, and the ratio of the throat divided by the start radius is within the range of about 0.6 through about 1.1.

8. A spray nozzle as defined in claim 1, wherein the swirl disk defines a thickness within the range of about 0.005 inch through about 0.015 inch.

9. A spray nozzle as defined in claim 1, wherein the orifice disk defines a thickness within the range of about 0.015 inch through about 0.025 inch.

10. A spray nozzle as defined in claim 1, wherein the ratio of an axial depth of the spray orifice (L) to a diameter of the spray orifice (D) is within the range of about 0.16 through about 6.

11. A spray nozzle as defined in claim 1, wherein the retaining member defines at least one flat, and the flat defines a fluid flow path between the retaining member and retaining body and extending between the inlet aperture of the retaining body and an annulus formed between the retaining member and retaining body for fluid flow therebetween.

12. A spray nozzle as defined in claim 1, further comprising a filter adjacent to the retaining member for preventing contaminants from entering the spray nozzle.

13. A spray nozzle as defined in claim 1, wherein the swirl disk further defines a plurality of swirl chambers and a plurality of corresponding swirl inlets, and each swirl inlet extends between a respective swirl chamber and the peripheral edge of the swirl disk.

14. A swirl disk for use in a spray nozzle, wherein the spray nozzle includes a retaining body defining an inlet aperture and an outlet aperture, an orifice disk defining a peripheral edge and a spray orifice spaced inwardly relative to the peripheral edge and extending therethrough, and a retaining member, wherein the orifice disk is receivable within the retaining body with the spray orifice aligned with and adjacent to the outlet aperture of the retaining body, the swirl disk comprising:

a sheet material substrate defining a thickness within the range of about 0.003 inch to about 0.03 inch, an etched peripheral portion defining a peripheral edge of the swirl disk, an etched first region spaced inwardly relative to the peripheral edge and forming a first aperture extending through the first region and defining a swirl chamber of the swirl disk, and an etched second region of the sheet material substrate extending between the swirl chamber and peripheral edge and defining a second aperture extending through the second region and forming a flow inlet to the swirl chamber of the swirl disk, wherein the swirl disk is receivable within the retaining body upstream of and contiguous to the orifice disk with the swirl chamber aligned and in fluid communication with the spray orifice of the orifice disk and at least one fluid passageway formed between the inlet aperture of the retaining body and the flow inlet to the swirl chamber, and an opposite side of the swirl disk relative to the orifice disk is engageable with the retaining member to secure the swirl disk and orifice disk within the retaining body.

15. A swirl disk as defined in claim 14, wherein the swirl disk further defines a first substantially planar surface on one side of the swirl disk, and a second substantially planar surface on an opposite side of the swirl disk.

16. A swirl disk as defined in claim 15, wherein the first and second surfaces are substantially symmetrical about a plane approximately perpendicular to an axis of the swirl disk.

17. A swirl disk as defined in claim 16, wherein the first and second surfaces of the swirl disk are substantially identical.

18. A swirl disk in combination with an orifice disk for use in a spray nozzle, wherein the spray nozzle includes a retaining body defining an inlet aperture and an outlet aperture, and a retaining member, the combination comprising:

an orifice disk formed of a sheet material substrate defining a thickness within the range of about 0.005 inch to about 0.03 inch, an etched peripheral portion defining a peripheral edge of the orifice disk, and an etched first region of the sheet material substrate spaced inwardly relative to the peripheral edge and defining a first aperture extending through the first region and forming a spray orifice of the orifice disk, wherein the orifice disk is receivable within the retaining body with the spray orifice aligned with and adjacent to the outlet aperture of the retaining body; and a swirl disk formed of a sheet material substrate defining a thickness within the range of about 0.003 inch to about 0.03 inch, an etched peripheral portion defining a peripheral edge of the swirl disk, an etched first region spaced inwardly relative to the peripheral edge and forming a first aperture extending through the first region and defining a swirl chamber, and an etched second region of the sheet material substrate extending between the swirl chamber and the peripheral edge and defining a second aperture extending through the second region and forming a flow inlet to the swirl chamber, wherein the swirl disk is receivable within the retaining body upstream of and contiguous to the orifice disk with the swirl chamber aligned and in fluid communication with the spray orifice of the orifice disk and at least one fluid passageway formed between the inlet aperture of the retaining body and the flow inlet to the swirl chamber, and an opposite side of the swirl disk relative to the orifice disk is retainable by the retaining member to secure the swirl disk and orifice disk within the retaining body.

19. A swirl disk for use in a spray nozzle, wherein the spray nozzle includes a retaining body defining an inlet aperture and an outlet aperture, an orifice disk defining a peripheral edge and a spray orifice spaced inwardly relative to the peripheral edge and extending therethrough, and a retaining member, wherein the orifice disk is receivable within the retaining body with the spray orifice aligned with and adjacent to the outlet aperture of the retaining body, the swirl disk comprising:

a sheet material substrate defining a thickness within the range of about 0.003 inch to about 0.03 inch, an etched peripheral portion defining a peripheral edge of the swirl disk, an etched first region spaced inwardly relative to the peripheral edge and forming a first aperture extending through the first region and defining a swirl chamber of the swirl disk, and an etched second region of the sheet material substrate extending between the swirl chamber and peripheral edge and defining a second aperture extending through the second region and forming a flow inlet to the swirl chamber of the swirl disk, wherein the swirl disk further defines a throat between an upstream end of the flow inlet and the swirl chamber, a start radius within the swirl chamber, and a throat ratio defined by the ratio of the throat to the start radius and within the range of about 3:5 to about 11:10, wherein the swirl disk is receivable within the retaining body upstream of and contiguous to the orifice disk with the swirl chamber aligned and in fluid communication with the spray orifice of the orifice disk and at least one fluid passageway formed between the inlet aperture of the retaining body and the flow inlet to the swirl chamber, and an opposite side of the swirl disk relative to the orifice disk is retainable by the retaining member to secure the swirl disk and orifice disk within the retaining body.

20. A spray nozzle comprising:

means for generating a swirling flow of fluid formed of a sheet material substrate defining a thickness within the range of about 0.003 inch to about 0.03 inch, an etched peripheral edge, an etched first region spaced inwardly relative to the peripheral edge and forming a first aperture extending through the first region and defining means for swirling fluid within the means for generating, and an etched second region extending between the means for swirling and the peripheral edge and defining a second aperture extending through the second region and forming means for introducing a flow of fluid into the means for swirling;

means for emitting a spray of fluid exiting the means for generating and formed of a sheet material substrate defining a thickness within the range of about 0.005 inch to about 0.03 inch, an etched peripheral portion defining a peripheral edge, and an etched first region spaced inwardly relative to the peripheral edge and defining a first aperture extending through the first region and forming a spray orifice in fluid communication with the means for swirling for receiving the swirling fluid and emitting a spray of such fluid therethrough;

means for retaining the means for generating and means for emitting and defining an inlet aperture in fluid communication with the means for generating for introducing fluid into the means for generating and an outlet aperture in fluid communication with the means for emitting for emitting the spray of fluid therethrough; and means receivable within the means for retaining for securing the means for generating and means for emitting within the means for retaining.

21. A spray nozzle as defined in claim 20, wherein the means for emitting is received within the means for retaining with the spray orifice aligned with and adjacent to the outlet aperture of the means for retaining, the means for generating is received within the means for retaining upstream of and contiguous to the means for emitting with the means for swirling aligned and in fluid communication with the spray orifice of the means for emitting, and the means for securing is in engagement with an opposite side of the means for generating relative to the means for emitting.

22. A spray nozzle as defined in claim 21, wherein the means for generating is a swirl disk, the means for swirling is a swirl chamber of the swirl disk, the means for introducing is an inlet to the swirl chamber, the means for emitting is an orifice plate, the means for retaining is a nozzle body, and the means for securing is a retaining plug.

23. A spray nozzle as defined in claim 20, wherein the means for emitting emits the fluid from the spray orifice in a spray of droplets, and at least about 90% of the emitted spray is composed of droplets having diameters of less than about 62.8 microns at a fluid pressure in the range of about 1000 psi to about 3000 psi.

24. A spray nozzle as defined in claim 23, wherein the spray of droplets defines a Sauter Mean Diameter on the order of about 20 microns.

* * * * *